US006588028B1

(12) United States Patent
Wu

(10) Patent No.: US 6,588,028 B1
(45) Date of Patent: Jul. 8, 2003

(54) INFLATABLE POOL WITH INFLATABLE POSTS ALONG ITS OUTER PERIPHERY

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 10/195,647

(22) Filed: Jul. 11, 2002

(51) Int. Cl.[7] ..... E04H 4/00
(52) U.S. Cl. ..... 4/506
(58) Field of Search ..... 4/506, 585; 220/413

(56) References Cited

U.S. PATENT DOCUMENTS 2,854,049 A * 9/1958 Wyllie ..... 4/506 X
3,631,544 A * 1/1972 Tytel ..... 4/506
4,893,362 A * 1/1990 Murphy ..... 4/585 X
5,416,932 A * 5/1995 Ventrice ..... 4/506 X

* cited by examiner

*Primary Examiner*—Robert M. Fetsuga
(74) *Attorney, Agent, or Firm*—Allston L. Jones

(57) ABSTRACT

An inflatable pool includes inflatable first and second annular members, a plurality of inflatable posts, each of which has two ends connected respectively and fixedly to the first and second annular members, a bottom wall having a periphery that is connected sealingly to an inner periphery of the second annular member, and an annular upright side wall unit that abuts against the posts.

5 Claims, 4 Drawing Sheets

INFLATABLE POOL WITH INFLATABLE POSTS ALONG ITS OUTER PERIPHERY

BACKGROUND OF THE INVENTION

1. Field of the Invention

The invention relates to an inflatable pool, more particularly to an inflatable pool with inflatable posts along its outer periphery.

2. Description of the Related Art

Referring to FIGS. 1 to 3, a conventional inflatable. pool 100 is adapted to be filled with water, and is shown to include first, second, and third ring members 11, 12, 13, and a bottom wall 15. The ring members 11, 12, 13 are stacked and interconnected by a heat-sealing process. The bottom wall 15 is heat-sealed to an inner periphery of the third ring member 13, and cooperates with the ring members 11, 12, 13 to define an open receiving space 16.

When the receiving space 16 is empty, the ring members 11, 12, 13 can form a vertical row, as shown in FIG. 3. When water starts to fill the receiving space 16, the second and third ring members 12, 13 are pulled outwardly by water pressure, thereby deforming the second and third ring members 12, 13, as shown in FIGS. 1 and 2. Since the inflatable pool 100 is deformed, a push-pull force occurs among the ring members 11, 12, 13, thereby weakening their connection, and thereby shortening the service life of the inflatable pool 100.

FIG. 4 illustrates another conventional inflatable pool 200 disclosed in U.S. Design Patent No. D408,546. The inflatable pool 200 includes a ring member 21, a bottom wall 23, and a plurality of interconnected side walls 25. The bottom wall 23 and the side walls 25 are made of a single-layer plastic material. Each of the side walls 25 has an upper end connected continuously to a lower periphery of the ring member 21 by thermal welding, and a lower end connected continuously to an inner periphery of the bottom wall 23 by thermal welding, thereby defining an open receiving space 27. When the receiving space 27 is not fully filled with water, the side walls 25 cannot completely lift the ring member 21 upwardly due to its flexible material such that the pool 200 cannot be used at this time. When water is fully filled into the receiving space 27, water pressure exerted on the side walls 25 will enable the latter to raise the ring member 21 completely, thereby permitting use of the inflatable pool 200. However, since water level of the inflatable pool 200 is relatively high, it can pose danger to small children who play in the pool 200.

SUMMARY OF THE INVENTION

Therefore, the main object of the present invention is to provide an inflatable pool that is free of the aforesaid drawbacks of the prior art.

According to this invention, an inflatable pool comprises an inflatable first annular member, an inflatable second annular member, a plurality of spaced-apart inflatable posts, a bottom wall, and an annular upright side wall unit. The second annular member is opposite to the first annular member. Each of the inflatable posts has two ends that are connected respectively and fixedly to the first and second annular members. The bottom wall has a periphery that is connected sealingly to an inner periphery of the second annular member. The side wall unit includes a flexible sheet member, and has upper and lower ends that are connected respectively and sealingly to the first and second annular members along the full length of the first and second annular members. The side wall unit abuts against the posts.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
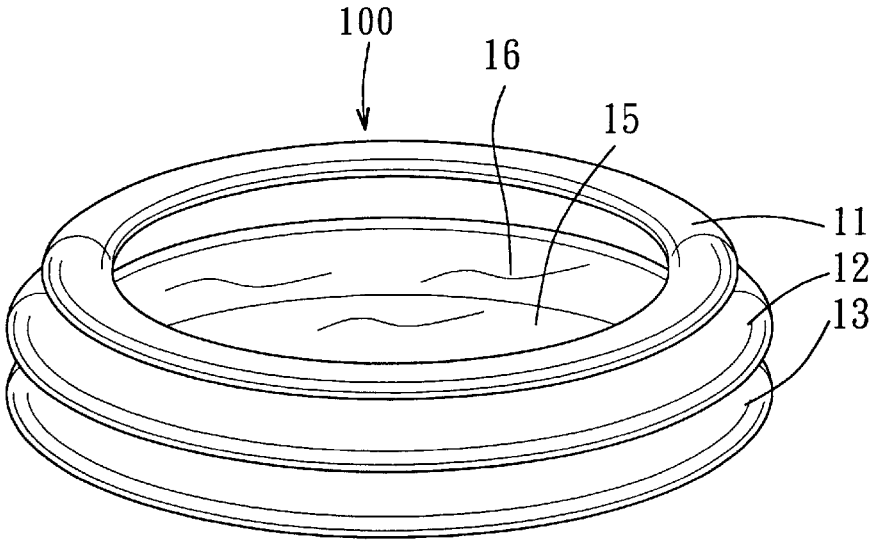
FIG. 1 PRIOR ART
FIG. 1 is a perspective view of a conventional inflatable pool in a condition for use.
Figure 2:
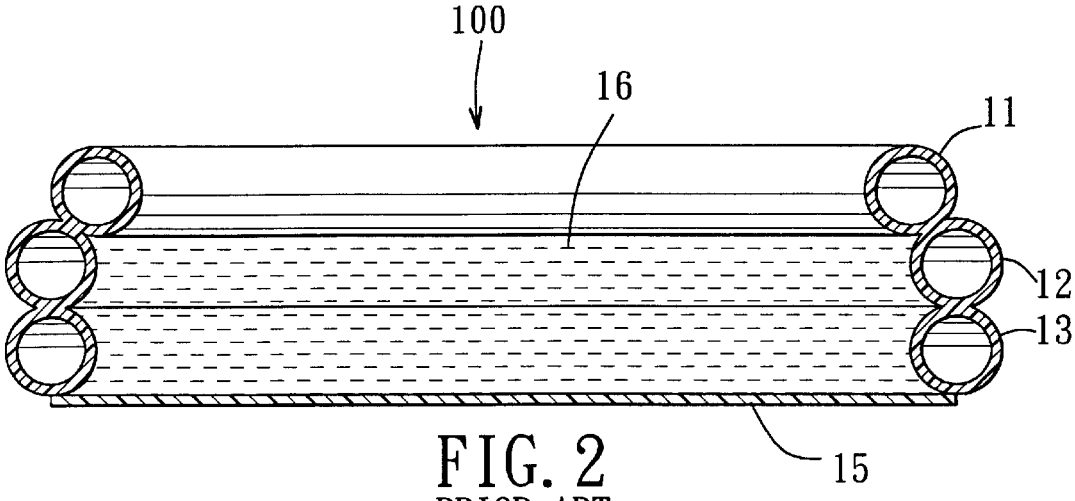
FIG. 2 PRIOR ART
FIG. 2 is a sectional view of the inflatable pool of FIG. 1, illustrating the arrangement of three ring members after water is filled into the pool.
Figure 3:
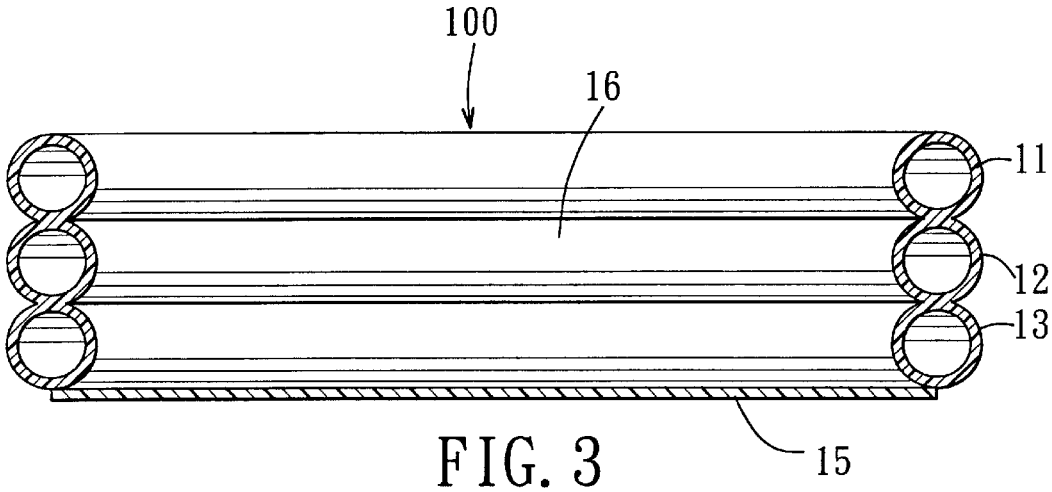
FIG. 3 PRIOR ART
FIG. 3 is another sectional view of the inflatable pool of FIG. 1, illustrating the arrangement of the ring members before water is filled into the pool.
Figure 4:
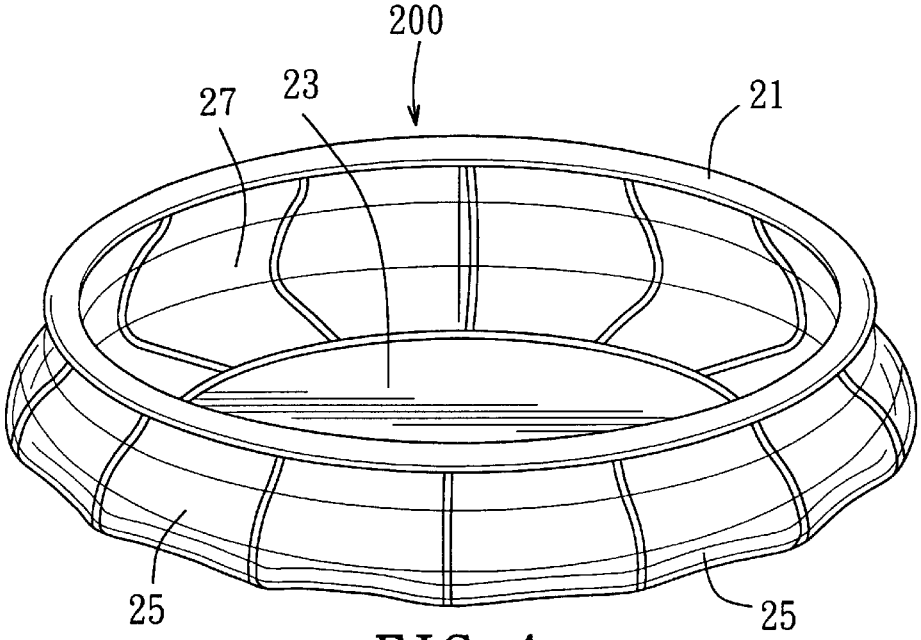
FIG. 4 PRIOR ART
FIG. 4 is a perspective view of another conventional inflatable pool.
Figure 5:
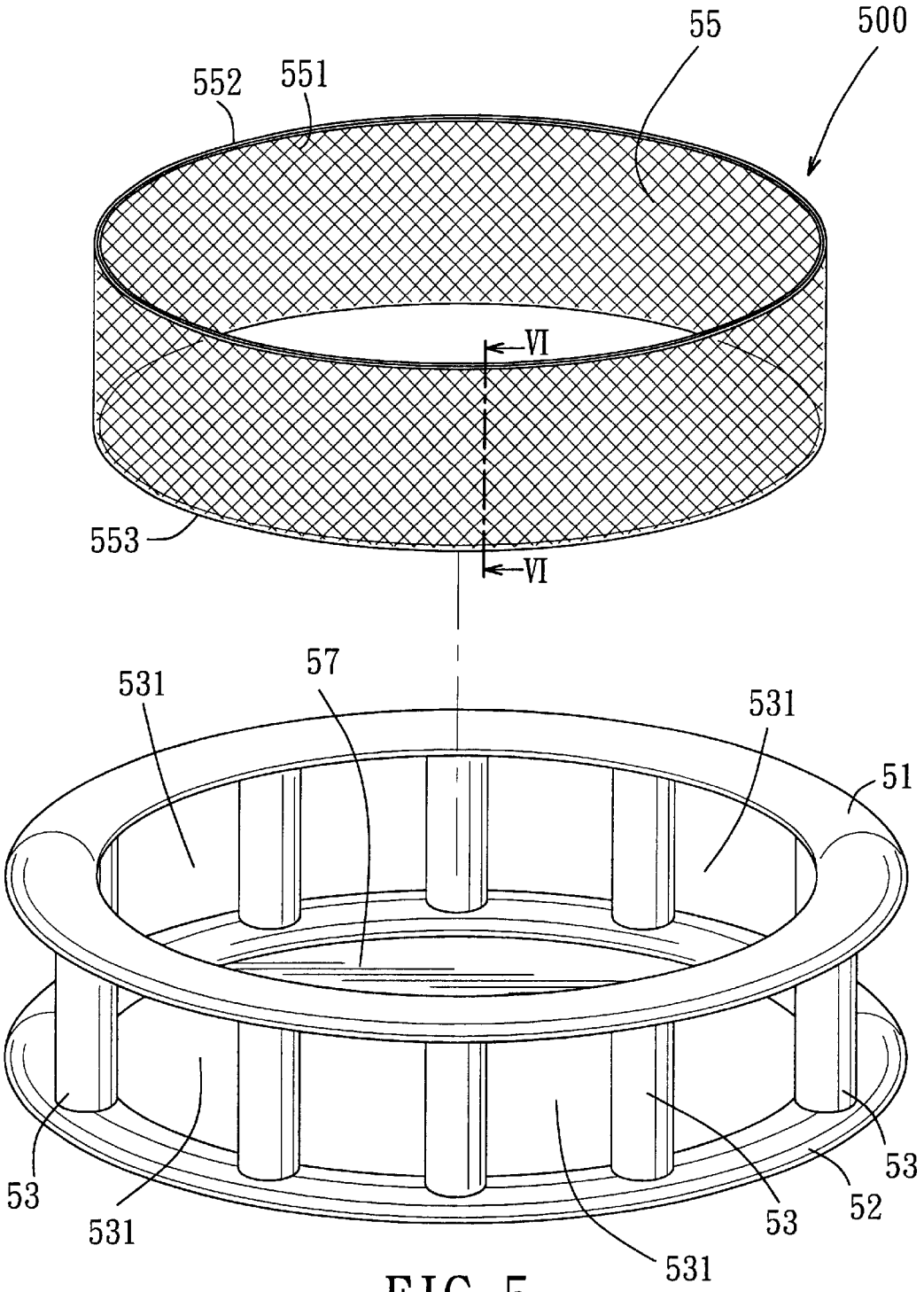
FIG. 5 is a partly exploded perspective view of the preferred embodiment of an inflatable pool according to the present invention.
Figure 6:
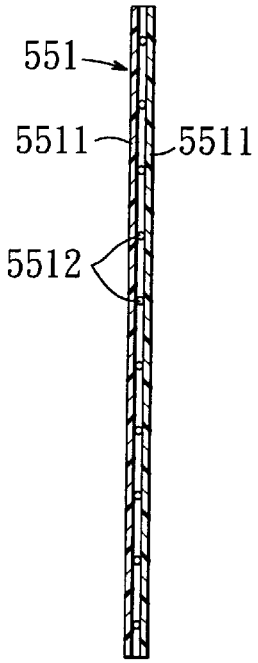
FIG. 6 is a cross-sectional view of a side wall unit of the preferred embodiment.
Figure 7:
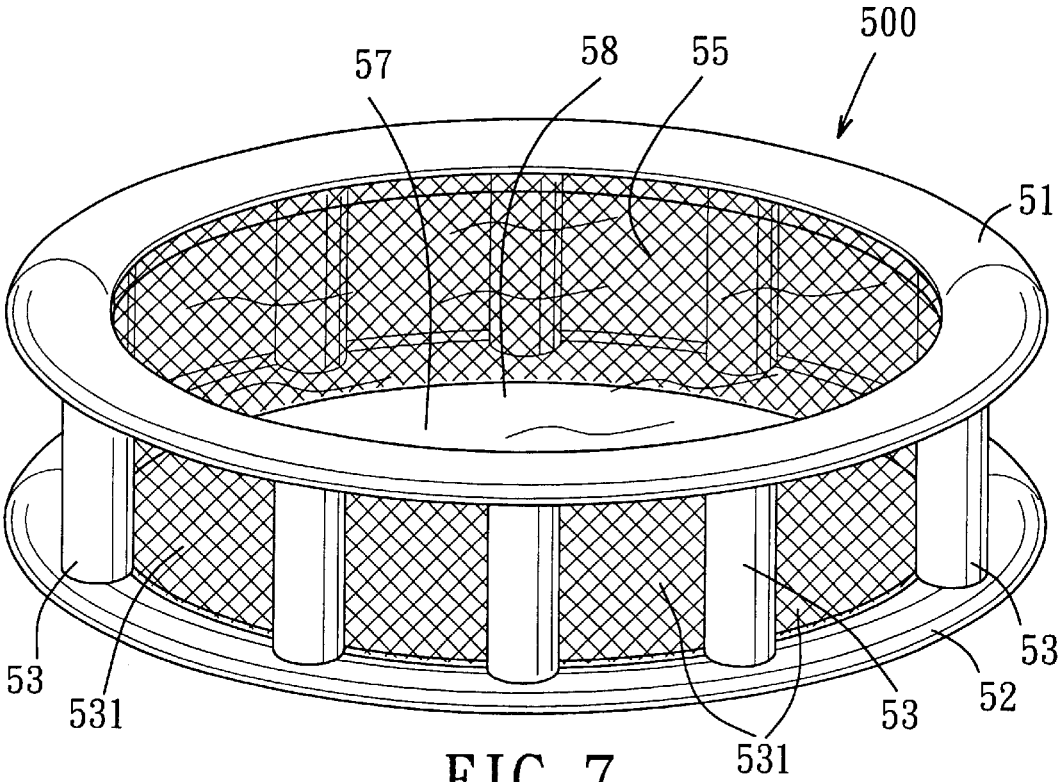
FIG. 7 is a perspective view of the preferred embodiment in a condition for use.

Referring to FIGS. 5 to 7, the preferred embodiment of an inflatable pool 500 according to the present invention is shown to comprise an inflatable first annular member 51, an inflatable second annular member 52 opposite to the first annular member 51, a plurality of circumferentially spaced-apart inflatable posts 53, a bottom wall 57, and an annular upright side wall unit 55.

In this embodiment, each of the inflatable first and second annular members 51, 52 has a ring-shaped cross-section after inflation.

Each of the inflatable posts 53 has two ends that are connected respectively and fixedly to the first and second annular members 51, 52. Each adjacent pair of posts 53 defines a rectangular window 531 therebetween. If the inflatable posts 53 are in fluid communication with the first and second annular members 51, 52, inflation done at a certain point can inflate the inflatable posts 53 and the first and second annular members 51, 52 at the same time. However, if a puncture exists, the inflatable posts 53 and the first and second annular members 51, 52 will be deflated at the same time. If the inflatable posts 53 are not in fluid communication with the first and second annular members 51, 52, it is necessary to inflate the inflatable posts 53 and the first and second annular members 51, 52 individually. However, a puncture will not affect the inflatable posts 53 and the first and second annular members 51, 52 at the same time.

The bottom wall 57 has a periphery that is connected sealingly to an inner periphery of the second annular member 52.

The posts 53 are disposed around and abut against the side wall unit 55. The side wall unit 55 includes a flexible sheet member 551, and has upper and lower ends 552, 553 that are connected respectively and sealingly to the first and second annular members 51, 52 along the full length of the first and second annular members 51, 52. The sheet member 551 is a multi-layer sheet which includes two sheet layers 5511 and a reinforcing net layer 5512 sandwiched between the sheet layers 5511. The sheet layers 5511 are made of a transparent plastic material. During assembly, the side wall unit 55 is formed into a ring shape, after which it is connected to the first and second annular members 51, 52 by means of thermal welding. Thus, the upper end 552 of the side wall unit 55 is heat-sealed to the first annular member 51, and the lower end 553 of the side wall unit 55 is heat-sealed to the bottom wall 57. The lower end 553 is connected to a junction between the posts 53 and the bottom wall 57 so that an open receiving space 58 is defined within the side wall unit 55.

In use, after the first and second annular members 51, 52 and the posts 53 are inflated with air, water can be filled into the receiving space 58. As the water is filled into the receiving space 58, the side wall unit 55 is maintained at a vertical position due to support of the first and second annular members 51, 52 and the posts 53. Furthermore, a push-pull force occurring at the connections among the first annular member 51, the second annular member 52, the side wall unit 55, and the bottom wall 57 is weakened, thereby prolonging the service life of the inflatable pool 500. Moreover, since the sheet layers 5511 of the side wall unit 55 are transparent, children playing in the inflatable pool 500 can be observed by their parents via the windows 531, thereby ensuring safety of the children.

In this invention, the side wall unit 55 of the inflatable pool 500 can be replaced by a plurality of separate wall members that are mounted respectively and sealingly within the windows 531.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An inflatable pool comprising:

an inflatable first annular member;

an inflatable second annular member opposite to said first annular member;

a plurality of spaced-apart inflatable posts, each of which has two ends that are connected respectively and fixedly to said first and second annular members;

a bottom wall having a periphery that is connected sealingly to an inner periphery of said second annular member; and an annular upright side wall unit including a flexible sheet member, and having upper and lower ends that are connected respectively and sealingly to said first and second annular members along the full length of said first and second annular members, said side wall unit abutting against said posts.

2. The inflatable pool as claimed in claim 1, wherein said sheet member is a multi-layer sheet which includes two sheet layers and a reinforcing net layer sandwiched between said sheet layers.

3. The inflatable pool as claimed in claim 2, wherein said sheet layers are transparent.

4. The inflatable pool as claimed in claim 1, wherein each of said first and second annular members and said side wall unit is shaped as a ring.

5. The inflatable pool as claimed in claim 1, wherein said side wall unit is shaped as a ring, each of said first and second annular members having a ring-shaped cross-section after inflation.

* * * * *